US006145163A

United States Patent [19]

Mitchell et al.

[11] Patent Number: 6,145,163

[45] Date of Patent: Nov. 14, 2000

[54] CHECK STRAP ASSEMBLY FOR A MOTOR VEHICLE

[75] Inventors: Stephen J. Mitchell, Walled Lake; Angelo DeSimone, Washington, both of Mich.

[73] Assignee: Chrysler Corporation, Auburn Hills, Mich.

[21] Appl. No.: 09/141,189

[22] Filed: Aug. 27, 1998

[51] Int. Cl.[7] ..... E05F 5/02

[52] U.S. Cl. ..... 16/82

[58] Field of Search ..... 16/82, 85, 86 C, 16/86 R; 292/147, 275, 271; 220/4.22, 8.34, 8.35, 326, 324, 4.02, 3.8, 784, 786, 788

[56] References Cited

U.S. PATENT DOCUMENTS

| | | | |
|---|---|---|---|
| 2,665,353 | 1/1954 | Popp | 220/3.8 |
| 2,977,019 | 3/1961 | Henchert | 220/784 |
| 4,788,743 | 12/1988 | Okumura | 16/82 |
| 5,173,991 | 12/1992 | Carswell | 16/86 A |
| 5,328,046 | 7/1994 | Kutz et al. | 220/226 |
| 5,474,344 | 12/1995 | Lee | 292/262 |
| 5,727,287 | 3/1998 | Hosken et al. | 16/82 |
| 5,785,203 | 7/1998 | Arshinoff et al. | 220/783 |
| 5,862,570 | 1/1999 | Lezuch et al. | 16/82 |

FOREIGN PATENT DOCUMENTS

| | | | |
|---|---|---|---|
| 88/05015 | 7/1988 | WIPO | B65D 43/06 |

OTHER PUBLICATIONS

Copending U.S. Serial No. 08/779,583.

*Primary Examiner*—Anthony Knight
*Assistant Examiner*—Vishal Patel
*Attorney, Agent, or Firm*—James R. Yee

[57] ABSTRACT

A check strap arrangement for a motor vehicle door includes a dust cover which is easily and rapidly assembled without the use of separate fastening operations, tools or fasteners. The check strap housing is provided with spherical recesses and the dust cover is provided with cooperating detents. The cover detents are adapted to be snap fitted into the recesses of the check strap housing so as to securely retain the cover on the check strap housing.

18 Claims, 2 Drawing Sheets

CHECK STRAP ASSEMBLY FOR A MOTOR VEHICLE

BACKGROUND OF THE INVENTION

1. Technical Field

The present invention generally pertains to articulating doors for motor vehicles. More particularly, the present invention pertains to a check strap assembly for a motor vehicle having a dust cover to prevent contamination of moving parts.

2. Discussion

In a conventional manner, passenger doors of motor vehicles are pivotally mounted to the vehicle body for movement between a fully open position and a closed position. Modernly, many such vehicle doors are designed to cooperate with a check strap which is operative for positively locating the door relative to the vehicle body at an intermediate position between the fully open position and the closed position. In situations where space laterally adjacent to a passenger door prohibits the door from fully opening, opening of the door to the intermediate position reduces incidents of unintentional damage to the door, to adjacent vehicles, or both.

In one common form, prior check straps for vehicle doors include a roller mounted to the vehicle body and an arm contoured to cooperate with the roller which is carried by the vehicle door. As the door is moved between its fully open position and its closed position, the arm and the roller cooperatively function to positively define an intermediate position at which the door may be located relative to the vehicle body. In another known arrangement, a check strap includes a checking mechanism that cooperates with a link member. Such an arrangement is shown and described in U.S. Pat. No. 5,173,991 which is hereby incorporated by reference as if fully set forth herein.

While known arrangements have proven to be commercially acceptable for certain application, they are all associated with specific disadvantages and thereby subject to improvement. For example, most known arrangements are susceptible to contamination from dust and other debris which may adversely affect operation of the check strap.

To a more limited extent, it has been heretofore proposed to provide a molded rubber boot for protecting a check strap housing from contamination. For example, such a molded rubber boot has been used on the 1993 Toyota Corolla. Stamped tabs extending from the check strap housing are received in slots provided in the rubber boot. During installation, the rubber boot is slipped over the metal tabs and the boot is pulled until the slots and tabs engage. Such an arrangement is disadvantageous in that attachment of the rubber boot to the housing is labor intensive. Furthermore, the rubber boot of this arrangement is relatively expensive to manufacture.

SUMMARY OF THE INVENTION

It is a general object of the present invention a check strap assembly for a passenger door of a motor vehicle which overcomes the disadvantages associated with the prior art, including but not limited to those discussed above. It is a related object of the present invention to provide a check strap assembly for a passenger door of a motor vehicle which includes a rigid dust cover.

It is another object of the present invention to provide a check strap assembly for a passenger door of a motor vehicle which is protected from dust and other contamination and which can be quickly and easily assembly without separate fastening operations, tools or fasteners.

In one form, the present invention provides a check strap assembly for a passenger door of a motor vehicle. The check strap assembly includes a check strap housing and a dust cover. One of a detent and a cooperating recess is formed on the check strap housing. The other of the detent and cooperating recess is formed on the dust cover. The cover is held in place on the housing through engagement of the detent with the recess.

Additional benefits and advantages of the present invention will become apparent to those skilled in the art to which this invention relates from a reading of the subsequent description of the preferred embodiment and the appended claims, taken in conjunction with the accompanying drawings.

DETAILED DESCRIPTION OF THE PREFERRED EMBODIMENT

Figure 1:
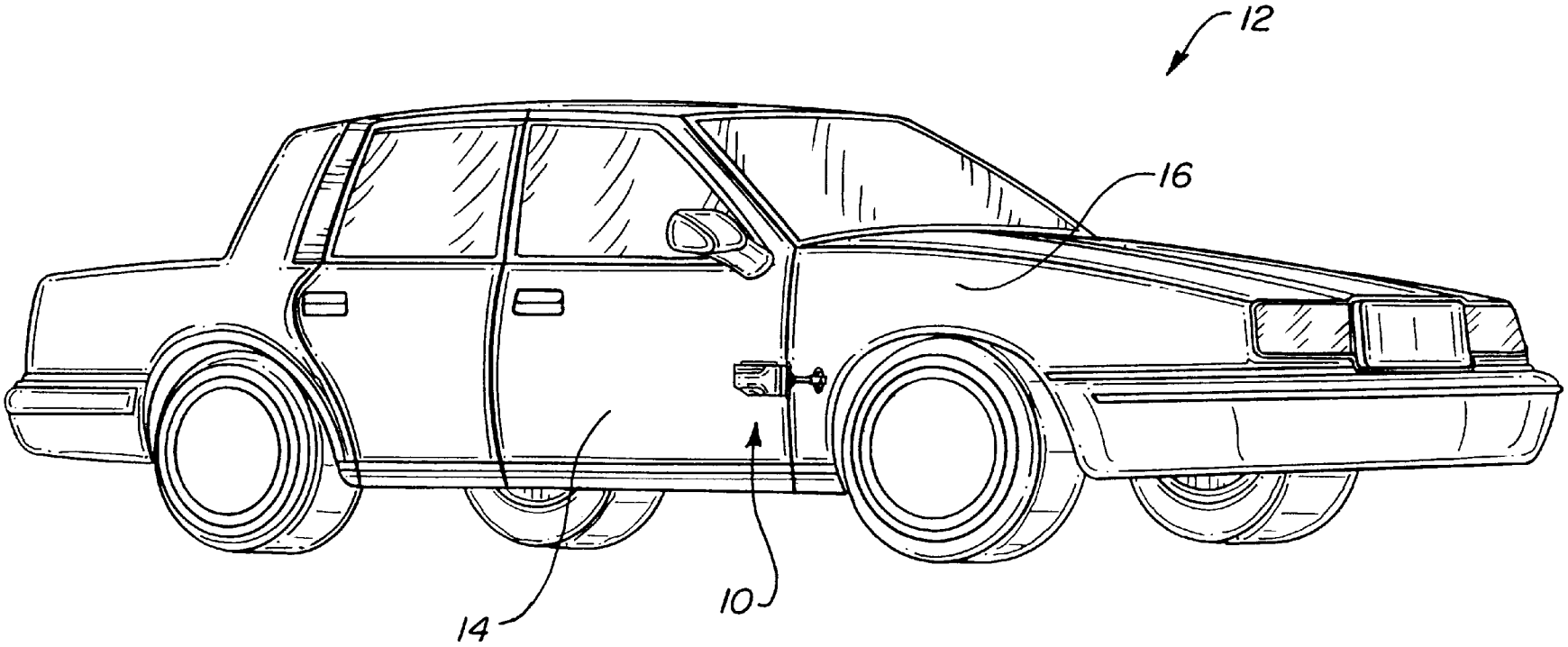
FIG. 1 is an environmental view of a check strap assembly constructed in accordance with the teachings of the preferred embodiment of the present invention and shown operatively installed within a vehicle so as to interconnect a passenger door with the body of the vehicle.

Turning generally to the drawings in which identical or equivalent elements have been denoted with like reference numerals, a check strap assembly constructed in accordance with the teachings of the preferred embodiment of the present invention is illustrated and identified with reference numeral 10. As shown in FIG. 1, the check strap assembly 10 is installed on an otherwise conventional vehicle 12 and functions to operatively interconnect a passenger door 14 of the vehicle 12 with the body 16 of the vehicle 12. The intended purpose of the check strap assembly 10 is to positively locate the passenger door 14 at an intermediate position between a fully open position and a fully closed position.

Figure 2:
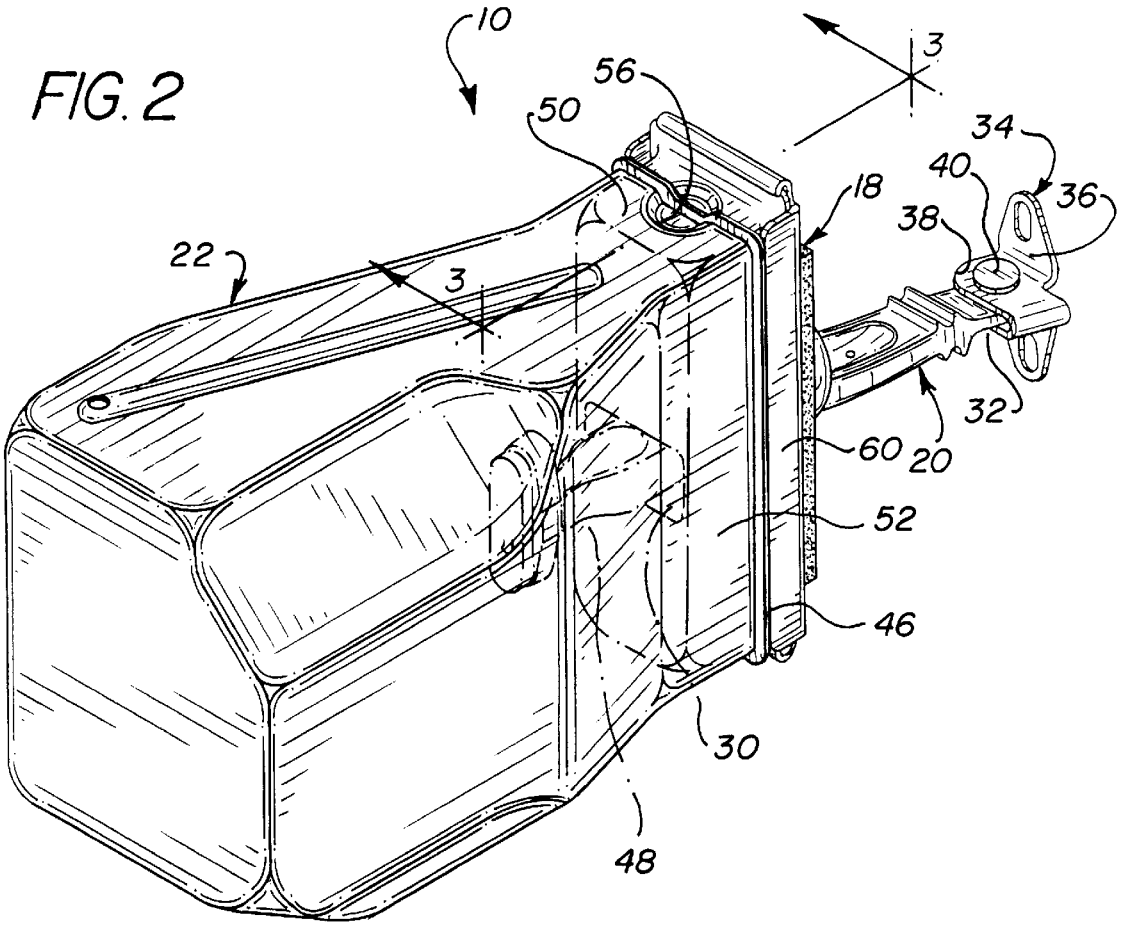
FIG. 2 is an enlarged perspective view of the check strap assembly of FIG. 1 shown removed from the vehicle for purposes of illustration.
Figure 3:
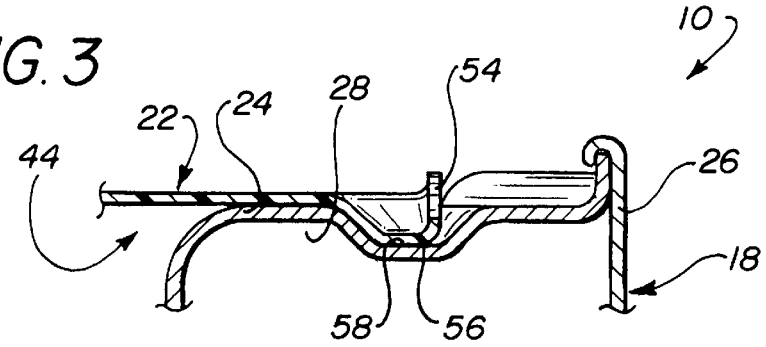
FIG. 3 is a cross-sectional view taken along the line 3—3 of FIG. 2.

With particular reference to FIGS. 2 and 3, the check strap assembly 10 of the present invention is shown to generally include a housing 18, a movable arm 20, an arm 20 and a dust cover 22. Much of the focus of the present invention is directed to the dust cover 22 and its attachment to the housing 18. Prior to describing the specific construction and function of the dust cover 22 of the preferred embodiment of the present invention, a basic understanding of the remaining components of the check strap assembly 10, which will be understood to be largely exemplary in nature, is warranted.

As shown in the drawings, the housing 18 of the check strap assembly 10 includes two portions 24 and 26 which are crimped together and define an internal cavity 28. As disclosed in U.S. Ser. No. 08/779,583, a channel 30 passes through the housing 18 through which the arm 20 passes. Disposed within the internal cavity of the housing 18 is a locating mechanism (not shown) for positively locating the arm 20 relative to the housing 18, and in turn, positively locating the door 14 relative to the body 16.

The arm 20 of the check strap assembly 10 is shown to include a first end 32 attached to the body 16 of the vehicle 12. More specifically, the first end 32 of the arm 20 is pivotally interconnected to the body 16 of the vehicle 12 through a mounting member 34. In the exemplary embodiment illustrated, the mounting member 34 includes a mounting portion 36 for attachment to the body 16 with bolts (not shown) and a flange 38 disposed perpendicular thereto having an aperture (not shown). The aperture receives a pivot pin 40 which passes through an aperture (not shown) formed in the first end 32.

The dust cover 22 of the check strap assembly 10 of the present invention is preferably unitarily constructed of a blow molded plastic. The dust cover 22 is illustrated to define an interior 44 and has an open end 46 for at least partially receiving the check strap housing 18. As shown in FIG. 2, the interior 44 of the dust cover 22 is adapted to receive a second end 48 of the arm 20. It will be understood that the second end 48 of the arm 20 moves in a horizontal direction within the interior 44 of the dust cover 22 as the motor vehicle door 14 is articulated between its closed and open positions.

The open end 46 of the dust cover 22 is cooperatively sized and shaped to receive the housing 18 of the check strap assembly 10. In the exemplary embodiment illustrated, the open end 46 of the dust cover 22 is generally rectangular in shape having a pair of spaced apart shorter sides 50 and a pair of spaced apart longer sides 52. A peripheral flange or lip 54 extends about the entire open end 46.

To provide means for releasably and quickly attaching the dust cover 22 to the check strap housing 18, the dust cover 22 is formed to include one of a detent 56 and a recess 58. The check strap housing 18 is formed to include the other of the detent 56 and recess 58. In the embodiment illustrated, the dust cover 22 is formed to include the detent 56 and the check strap housing 18 is formed to include the cooperating recess 58.

In the exemplary embodiment, the detent is generally spherical in shape and formed on one of the shorter sides 50 of the open end 46. As shown, the detent 56 is formed immediately adjacent the opening of the open end 46 such that the peripheral lip 54 passes through the detent 56.

The cooperating recess 58 of the check strap housing 18 is similarly shown to be generally spherical in shape. In the particular embodiment illustrated, the recess 56 is stamped into a cooperating surface of the housing 18 and is dish-shaped having a concavely curved circular perimeter and a flat bottom. In the exemplary embodiment illustrated, the detent 56 and cooperating recess 58 are shown located on a top side of the dust cover 22 and check strap housing 18, respectively. In the preferred embodiment, a substantially identical detent 56 and recess 58 are formed on the bottom sides of the dust cover 22 and check strap housing 18, respectively. Alternatively, it will be understood by those skilled in the art that the detents 56 and cooperating recesses 58 can be positioned in various other locations to releasably secure the dust cover 22 and check strap housing 18.

In use, the detent 56 and cooperating recess 58 are adapted to snappingly connect the dust cover 22 and check strap housing 18. The blow molded plastic of the dust cover 22 is permitted to resiliently distort upon engagement to thereby securely retain the dust cover 22. In the exemplary embodiment illustrated, the housing 18 is only partially received into the interior 44 of the dust cover 22. Advancement of check strap housing 18 into the interior 44 of the dust cover 22 is limited by crimped longer sides 60 of the check strap housing 18 which abut portions of the peripheral lip 54 adjacent the longer sides 52 of the open end 46 of the dust cover 22.

While the invention has been described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the description of the appended claims.

What is claimed is:

1. A check strap assembly for a passenger door of a motor vehicle, the check strap assembly comprising:

a check strap housing, said check strap housing including one of a detent and a cooperating recess;

a dust cover removably attached to said housing, said dust cover including the other of said detent and said cooperating recess; and an arm movably received by said housing, said arm having a first end adapted for attachment to a body of the motor vehicle and a second end received in an interior or said cover;

whereby said cover is held in place on said housing by engaging said detent with said recess.

2. The check strap assembly for a passenger door of a motor vehicle of claim 1, wherein said check strap housing includes said recess and said dust cover includes said detent.

3. The check strap assembly for a passenger door of a motor vehicle of claim 1, wherein said dust cover is in snapping engagement with said housing.

4. The check strap assembly for a passenger door of a motor vehicle of claim 2, wherein said dust cover includes an open end having a peripheral lip, said detent formed on said peripheral lip.

5. The check strap assembly for a passenger door of a motor vehicle of claim 2, wherein said dust cover is unitarily constructed of a blow molded plastic.

6. The check strap assembly for a passenger door of a motor vehicle of claim 1, in combination with the motor vehicle.

7. A check strap assembly for a passenger door of a motor vehicle, the check strap assembly comprising:

a check strap housing having a box-shape and adapted to be attached to the passenger door, said check strap housing including one of a detent and a cooperating recess;

a dust cover defining an interior and including an open end which partially receives said housing, said dust cover including the other of said detent and said cooperating recess; and an arm movably received by said housing, said arm having a first end adapted for attachment to the body and a second end received in said interior of said dust cover;

whereby said cover is held in place on said housing by engaging said detent with said recess.

8. The check strap assembly for a passenger door of a motor vehicle of claim 7, wherein said check strap housing includes said recess and said dust cover includes said detent.

9. The check strap assembly for a passenger door of a motor vehicle of claim 8, wherein said housing has a generally rectangular cross-section and said opening in said dust cover has a corresponding rectangular shape.

10. The check strap assembly for a passenger door of a motor vehicle of claim 9, wherein said housing includes a pair of short sides and a pair of long sides, said detent formed in one of said short sides.

11. The check strap assembly for a passenger door of a motor vehicle of claim 8, wherein said detent has a generally concave shape.

12. The check strap assembly for a passenger door of a motor vehicle of claim 11, wherein said recess is only partially received into said interior of said dust cover.

13. The check strap assembly for a passenger door of a motor vehicle of claim 7, wherein said dust cover is unitarily constructed of a blow molded plastic.

14. In a motor vehicle having a passenger door and a body, a check strap assembly for positively locating the a passenger door relative to the body, the check strap assembly comprising:

a check strap housing secured to the passenger door, said check strap housing including one of a detent and a cooperating recess;

a dust cover removably attached to said housing, said dust cover including the other of said detent and said cooperating recess; and an arm movably received by said housing, said arm having a first end connected to the body and a second end received in an interior of said cover;

whereby said cover is held in place on said housing by engaging said detent with said recess.

15. The check strap assembly for a passenger door of a motor vehicle of claim 14, wherein said check strap housing includes said recess and said dust cover includes said detent.

16. The check strap assembly for a passenger door of a motor vehicle of claim 14, wherein said dust cover is in snapping engagement with said housing.

17. The check strap assembly for a passenger door of a motor vehicle of claim 15, wherein said dust cover includes an open end having a peripheral lip, said detent formed on said peripheral lip.

18. The check strap assembly for a passenger door of a motor vehicle of claim 15, wherein said dust cover is unitarily constructed of a blow molded plastic.

* * * * *